US005255395A

United States Patent [19]

Millette

[11] Patent Number: 5,255,395

[45] Date of Patent: Oct. 26, 1993

[54] VENTILATING SYSTEM FOR TOILET BOWL

[76] Inventor: Gilles L. Millette, 84, Bellevue Est, Magog, Quebec, Canada, J1X 3H5

[21] Appl. No.: 898,434

[22] Filed: Jun. 15, 1992

[51] Int. Cl.[5] ..... E03D 9/05

[52] U.S. Cl. ..... 4/216; 4/348

[58] Field of Search ..... 4/213, 216, 217, 347-352, 4/209

[56] References Cited

U.S. PATENT DOCUMENTS

| | | | |
|---|---|---|---|
| 1,767,930 | 6/1930 | Kahl | 4/217 |
| 2,119,529 | 6/1938 | Dick | 4/217 |
| 2,988,756 | 6/1961 | Hartley | 4/213 X |
| 3,416.167 | 12/1968 | Klemme | 4/217 |
| 3,916,459 | 11/1975 | Ivancevic | 4/213 |

FOREIGN PATENT DOCUMENTS

| | | | |
|---|---|---|---|
| 0596962 | 8/1959 | Italy | 4/209 |
| 2143872 | 2/1985 | United Kingdom | 4/209 R |

*Primary Examiner*—Charles E. Phillips
*Attorney, Agent, or Firm*—Roland L. Morneau

[57] ABSTRACT

The invention consists of a ventilating system and particularly a ventilating kit to be installed on a conventional toilet bowl at the rear of the toilet seat above the apertures used to anchor the toilet seat to the toilet bowl. The kit includes a parapet-like housing having a peripheral wall member adapted to be mounted over and in contact with the back apron of the toilet bowl and disposed to encircle both apertures vertically extending therethrough. A pair of hollow T-shaped couplings are adapted to be mounted below each of the apertures for providing an air passageway from the housing through the apertures and into a piping arrangement which projects into an adjacent wall of the toilet room wherein a suction device is located. A cover is fittingly mounted over the parapet-like housing and has a pending lip facing the seat cover and adjacent thereto for defining an air passageway extending between the rear of the bowl and inside the housing. Upon actuation of the suction device, air is withdrawn from the bowl adjacent the seat cover, through the housing and the apertures located through the apron. The air pathway extends through the couplings and through the piping arrangement for projecting the air through the walls of the toilet room. One of the essential features of the present invention consists of using the apertures conventionally provided through the apron at the rear of the toilet bowl.

6 Claims, 3 Drawing Sheets

VENTILATING SYSTEM FOR TOILET BOWL

BACKGROUND OF THE INVENTION

1. Field of the Invention

The present invention relates to a ventilating system for toilet bowls and in particular to a system which makes use of the apertures provided in the back apron of a toilet bowl for anchoring the toilet seat to the bowl.

The ventilating system can be constituted as a kit which serves as an anchoring device for the toilet seat combined with a suction channel for ventilating the toilet bowl.

2. Prior Art

U.S. Pat. No. 3,469,267 discloses an odor removing device for toilets which comprises a receiving duct extending between the toilet seat and the bowl and into an odor conduit provided at the rear of the toilet seat above the back apron of the toilet bowl.

Canadian patent No. 535,697 describes a forced-draft ventilator for toilet bowls comprising an exhaust passage located over the hinges of the toilet seat connected to a suction fan located on the side of the exhaust passage. The air does not go through the apertures in the back apron of the toilet bowl.

The prior art generally reveals that a channel is provided between the seat and the toilet bowl which extends to a suction device directly behind and above the bowl without making use of the apertures provided in the rear apron of the toilet seat for channeling the air sucked from the toilet bowl.

SUMMARY OF THE INVENTION

The ventilating system according to the present invention is particularly directed to a ventilating kit adapted to be mounted on the back apron of the toilet bowl behind the seat cover. The ventilating kit is located over the apertures in the back apron which are adapted to pivotally secure the seat cover. The ventilating kit includes a parapet-like housing having a rectangular peripheral wall member adapted to be mounted over and in contact with the apron and disposed to cover both anchoring apertures for the seat cover. The housing is hingedly connected to the hinge member of the seat and seat cover. Under the apron, is mounted a hollow T-shaped coupling adapted to be pneumatically connected to the housing through the apertures. Means are included for securing the housing to the coupling through the apertures in abutting relationship with the apron. An air suction device is adapted to be connected to the coupling. A cover is also adapted to fit over the housing with a pending lip facing the seat cover, adjacent thereto and spaced from the apron, the cover defining an air pathway extending between the bowl and inside the peripheral wall of the housing. Upon actuation of the suction device, the air is withdrawn from the bowl below the seat cover through the housing and through the apertures and the couplings.

DETAILED DESCRIPTION OF THE DRAWINGS

Figure 1:
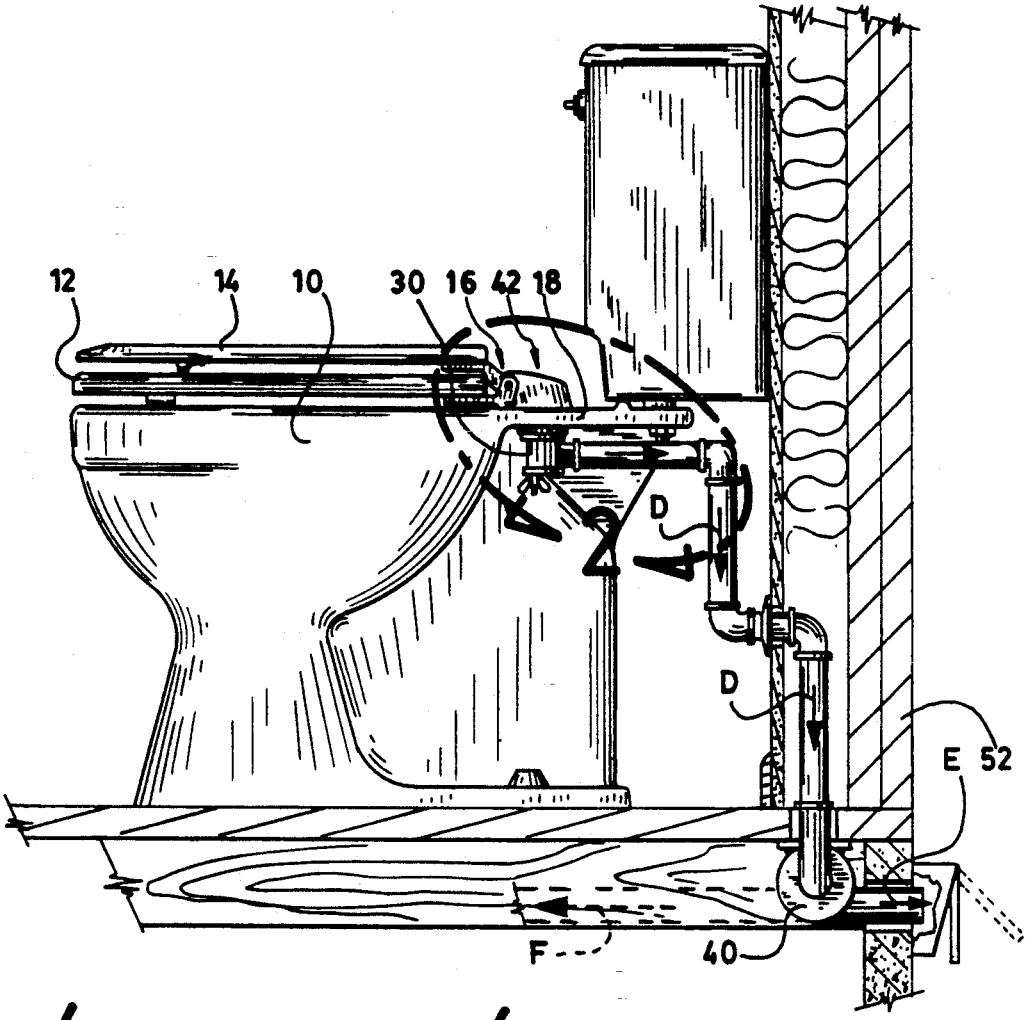
FIG. 1 is a side view of a toilet bowl connected to a ventilating system according to the invention.
Figure 2:
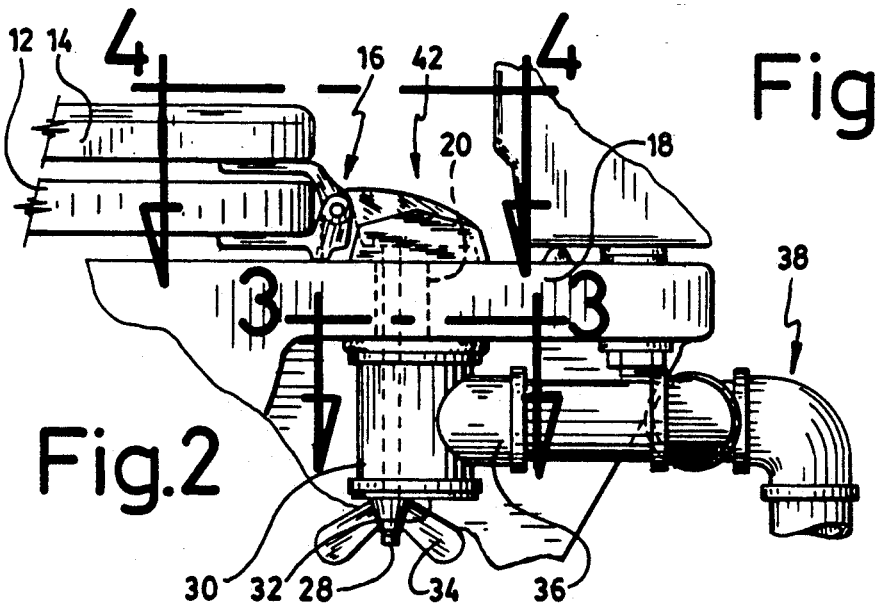
FIG. 2 is an enlarged view of the encircled portion 2 of FIG. 1.
Figure 4:
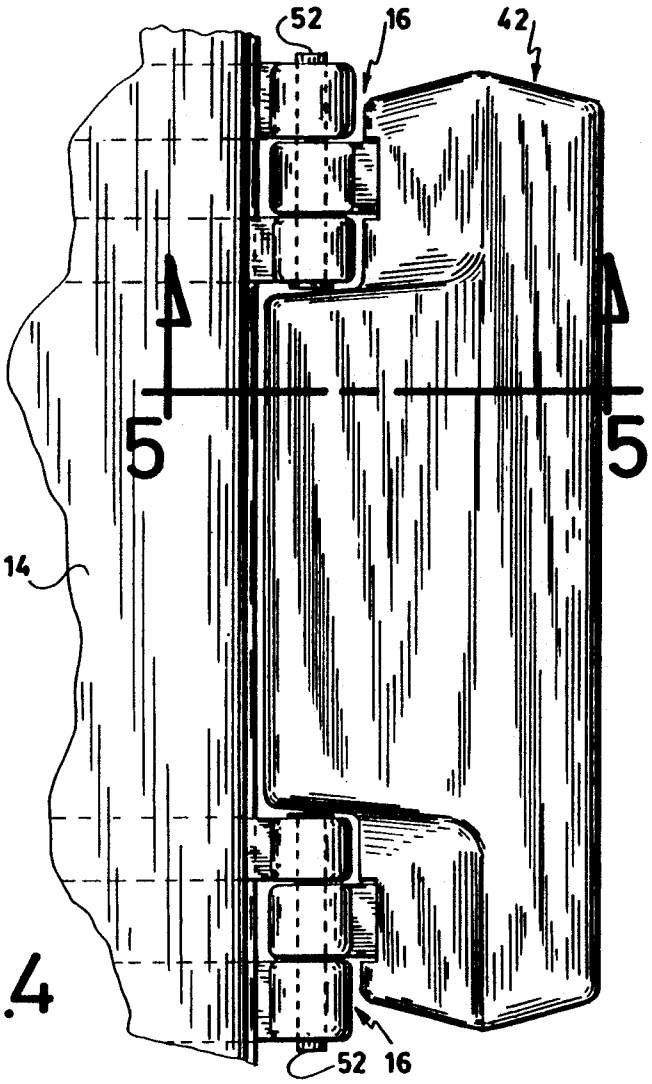
FIG. 4 is a cross-sectional view along line 4—4 of FIG. 2.

FIG. 1 illustrates a toilet bowl 10 on which is mounted a seat 12 and a seat cover 14 hingedly connected at the rear by a hinge member 16 over the back apron 18 of the toilet bowl 10. The present common practice for securing the hinge member 16 according to the present art consists of bolting the latter to the apron 18 through a pair of apertures 20 which extends through the apron 18. Such apertures 20 are usually fairly large, having a diameter of about $\frac{3}{8}$ to $\frac{5}{8}$ of an inch which is filled by a large plastic bolt extending through them. These apertures are used exclusively for locating the bolts which have substantially the same diameter as the apertures 20.

One of the essential features of the present invention is to use the apertures 20 as an intermediate portion of the ventilating channel which allows the ventilating piping to be hidden under the apron 18 instead of extending over it. Such astute direction of the air pathway improves the appearance of the ventilated bowl having a ventilating system which are provided with a piping arrangement completely above the apron.

Considering that the present invention can be installed on a conventional toilet bowl and seat cover, the new components can be provided as a kit to be substituted for the present means for anchoring the seat cover and the toilet seat on the back apron.

The assembly according to the invention comprises a parapet-like housing 22 having a peripheral wall which is sufficiently elongated to cover both apertures 20. The lower edge of the housing is flat and abuts over the upper surface of the apron 18 and is provided with a forward hooking member 24 to allow the seat 12 and the seat cover 14 to pivot thereabout along a common axle. The housing 22 is provided at both ends with a slot 26 for holding the head of the anchoring bolts 28. The bolts 28 are located to extend down the apertures 20 and through a pair of T-shaped couplings 30 having a vertical and a lateral channel. The couplings 30 are open at the upper end of their vertical channel to allow the air to pass from the apertures 20 down through the couplings 30 and is closed at their lower ends with perforated plates 32 which allow the bolts 28 to extend therethrough. A wing nut 34 serves to tighted the housing 22 to each coupling 30 in solid abutment with the apron 18. The couplings 30 have an opened lateral channel projection 36 extending rearwardly and adapted to be fitted to a piping arrangement 38. The piping arrangement 38 preferably extends to an adjacent wall of the toilet room in order to reach a ventilating fan 40 hidden from view and possibly sufficiently remote to minimize the sound of the fan.

Figure 5:
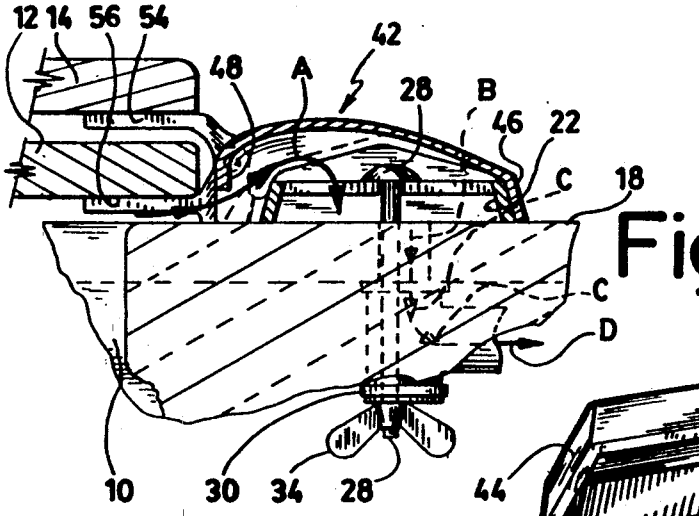
FIG. 5 is a cross-sectional view taken along line 5—5 of FIG. 4.

A cover 42 is adapted to be fitted over the parapet-like housing 22 to define the pathway of the air passage from the toilet bowl 10 to the piping arrangement 38. The cover 42 has two sidewalls 44 and a rear wall 46 fittingly surrounding the corresponding peripheral walls of the housing 22 and a front wall 48 forwardly and spacedly located relative to the corresponding forward peripheral wall of the housing 22. The front wall 48 has a lower edge 50 which is spaced above the upper surface of the apron 18 at a level which allows the air from cavity 51 of the bowl 10 to flow under the seat 12 and extend under the edge 50 and below the upper surface of the cover 42 and down inside the parapet-like housing 22 along the arrow A shown in FIG. 5. The bolt 28 which has a cross-sectional dimension substantially reduced from the cross-sectional dimension of the aperture 20, allows the air to flow through the arrows B and down into the coupling 30 along the arrow C and into the piping arrangement 38 along the arrow D (see FIG. 5).

The upper surface of the cover 42 is maintained in spaced relationship with the parapet-like housing 22 so as to allow flowing through the arrow A to meet no hinderence from the cover. The cover 42 is dimensioned to be fittingly surrounding the housing 22 so as to prevent unintentional removing of the cover 42.

The lower surface of the parapet-like housing 22 is preferably designed to be in abutting contact with the upper surface of the apron 18 so as to prevent any water unintentionally overflowing from the toilet bowl 10 to flow into the housing 22 towards the couplings 30 and the piping arrangement 38. The slots 26 are provided into an inward upper ledge 51 at both ends of the housing 22. Considering that the conventional apertures 20 in toilet bowls are substantially located at the same distance from one make of bowls to the other, any small adjustment can be taken up by the length of the slots 26.

Figure 3:
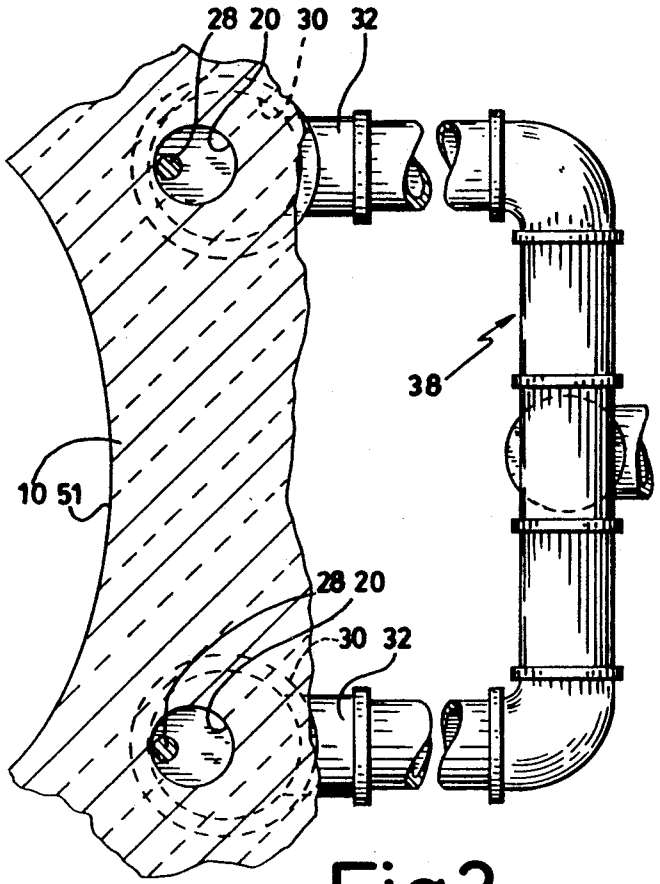
FIG. 3 is a cross-sectional view along line 3—3 of FIG. 2.

As it can be particularly seen in FIG. 3, the location of the bolts 28 relative to the aperture 20, is intentionally located along the periphery of the apertures 20 to prevent the seat 12 and the seat cover 14 to be laterally pushed over the bowl 10. The position of the bolts 28 may be appropriately located inside the apertures 20 along different parts of their periphery according to the shape of the apertures 20 and preferably in their most remote position relative to each other.

Although the present invention has been described with a pair of couplings 30, only one coupling having an elongated shape substantially corresponding to the periphery of the housing 22 can also be contemplated.

As illustrated in FIG. 1, the fan 40 is located adjacent a rear wall of the toilet bowl 10 to project air through the rear wall 52 along the arrow E. The arrow F in stippled line (FIG. 1) indicates that the fan could be located, as an alternative, in a forward direction of the toilet bowl 20 up to a nearby wall which may be suitably located for the installation of the fan 40.

Figure 6:
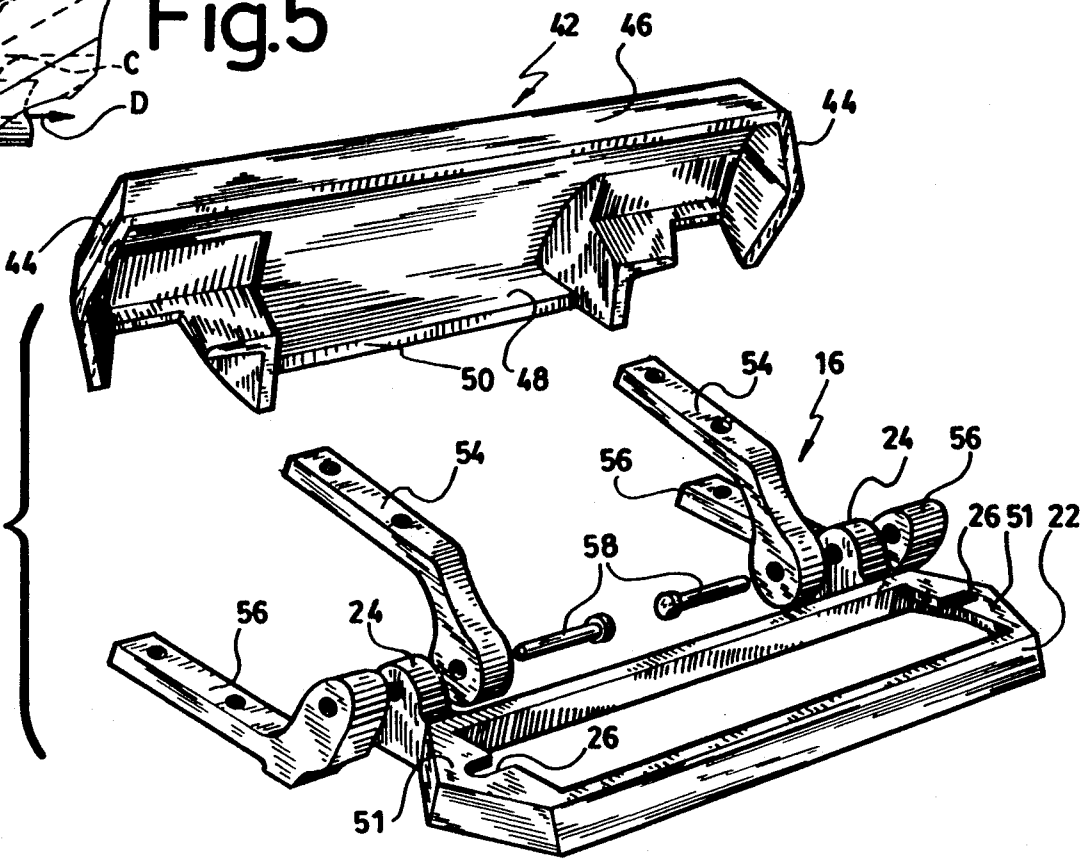
FIG. 6 is an exploded view of the parapet housing and its cover to be connected to a hinge member holding the seat cover of the toilet bowl.

As particularly shown in FIG. 6, the hinge member 16 has two components, that is, a member 54 adapted to be connected to the seat cover 14 and a member 56 adapted to be connected the seat 12. Depending on the hinge member 16 of a particular toilet bowl, the hooking member 24 of the hinge member 16 is connected to be fitted by a pair of coaxial pins 58 so that the seat 12 and the seat cover 14 are pivotally anchored to the housing 22 by the bolts 28. It should be understood that the cover 14 and its corresponding member 54 can be dispensed with or without changing the purport of the invention. Toilet bowls in public toilet rooms are generally not provided with seat covers.

I claim:

1. A toilet bowl ventilating kit for use with a conventional toilet bowl having a bowl portion with an upper rim and a generally flat apron portion extending rearwardly from a portion of the rim, a seat resting on the rim, a hinge member attached to a rear portion of said seat, said apron being provided with two vertical apertures extending therethrough for attachment of said hinge member, said kit comprising, a parapet-like housing having a peripheral wall member adapted to be mounted over and in contact with said apron and disposed to encircle both of said apertures, said housing having means for hingedly connecting said hinge member thereto so as to allow pivoting of said seat thereabout, two hollow couplings each being adapted to be mounted below and encircling one of said apertures with a mouth, and having an angularly disposed opening relative to said mouth adapted to be connected to an air suction device, connecting means extending through said apertures for retaining said parapet-like housing in position surrounding said apertures and for retaining said mouth encircling said aperture, as so to provide a stationary connection for said hinge member, a cover adapted to fit over said housing, said cover having a pending lip for facing said seat, said cover defining an air pathway extending from adjacent said bowl to the inside of said peripheral wall, whereby upon actuation of said suction device, air is withdrawn from said bowl below said seat through said housing, said apertures and said couplings.

2. A toilet bowl ventilating kit as recited in claim 1, wherein said connecting means comprises a rod extending through each of said apertures, said rod having a diameter sufficiently small to allow air to freely flow through said apertures.

3. A toilet bowl ventilating kit as recited in claim 2, wherein said rods are adapted to extend through said mouth of said couplings, said couplings having a perforated wall opposite said mouth for retaining said rods, and said parapet-like housing having a horizontal ledge member at each end of said housing for retaining said rods, and means for tightening said couplings and said housing against said apron.

4. A toilet bowl ventilating kit as recited in claim 3, wherein said perforated wall of each coupling has a hole adjacent the periphery of each coupling, said holes being located about said peripheries in opposite direction from one another for preventing said rods from moving inside said couplings and said apertures.

5. A toilet bowl ventilating kit as recited in claim 4, wherein said ledge has a slot for allowing lateral adjustment of said rods according to the distance between said apertures.

6. A toilet bowl ventilating kit as recited in claim 5, wherein said means for hingedly connecting said hinge member comprises a pivotable hooking member adapted to be coaxially engaged with said hinge member.

* * * * *